US006397637B2

(12) United States Patent
Sangiacomo

(10) Patent No.: US 6,397,637 B2
(45) Date of Patent: Jun. 4, 2002

(54) LIFTING DEVICE FOR KNITTED ITEMS CONSTRUCTED ON A CIRCULAR MACHINE

(75) Inventor: Fulvio Sangiacomo, Brescia (IT)

(73) Assignee: Sangiacomo S.p.A. (IT)

( * ) Notice: Subject to any disclaimer, the term of this patent is extended or adjusted under 35 U.S.C. 154(b) by 0 days.

(21) Appl. No.: 09/881,530

(22) Filed: Jun. 14, 2001

(30) Foreign Application Priority Data

Jun. 27, 2000 (IT) ..... BS000A59

(51) Int. Cl.[7] ..... D04B 9/40
(52) U.S. Cl. ..... 66/58; 66/148
(58) Field of Search ..... 66/147, 148, 58

(56) References Cited

U.S. PATENT DOCUMENTS 5,606,876 A * 3/1997 Sangiacomo ..... 66/58
5,647,229 A * 7/1997 Conti ..... 66/58
5,761,931 A * 6/1998 Lonati et al. ..... 66/58
6,164,091 A * 12/2000 Frullini et al. ..... 66/58

* cited by examiner

*Primary Examiner*—Danny Worrell
(74) *Attorney, Agent, or Firm*—McGlew and Tuttle, P.C.

(57) ABSTRACT

A device for lifting a knitted item made on a circular knitting machine for knitwear and hosiery. The device includes a lifting pipe 15 coaxial inside the cylinder, rotating with this, moveable in height between a lowered position and a raised position, and one bearing a summit bell 16 with a flared lip 19, which extends above the internal sinker crown to the close vicinity of the needs and which has radial slits 20 in line with the sinkers 12. The pipe with the summit bell is raised from the lowered position by dedicated control structure to raise the item, especially at areas closest to the needles.

13 Claims, 2 Drawing Sheets

LIFTING DEVICE FOR KNITTED ITEMS CONSTRUCTED ON A CIRCULAR MACHINE

FIELD OF THE INVENTION

This invention concerns circular machines for knitwear and hosiery, and refers especially to a device for raising a knitted item after it has been made, when it is taken from the needles and transferred by handling it out of the machine, for example to be able to effect the toe closing operation in the case of socks.

BACKGROUND OF THE INVENTION

Some circular machines for knitwear and hosiery employed for making knitted items to be taken and transferred out of the machine for successive complementary operations are equipped inside with a cylinder and a tube with summit flaring to receive the item as it being made by the needles. The tube can move vertically inside the cylinder to raise the item once finished, according to need, so that it can be taken close to the needles, taken off and removed above the cylinder with a suitable and known handling device. The flaring of the lifting pipe extends partially above the internal guide crown of the sinkers but cannot come close to the needles so as not to interfere with the sinkers when these are moving radially. In other words, the flared part of the pipe always remains at a distance from the needles and the closest part of the knitted item does not find any support on the pipe flaring. In this condition, when the tube is raised up it cannot completely and reliably raise the item so that it can be correctly and securely taken by the transfer device.

SUMMARY AND OBJECTS OF THE INVENTION

The purpose of this invention is therefore to provide a circular machine for knitwear and hosiery in which the operation of lifting the knitted item always takes place correctly and securely.

Another purpose of the invention is of offering a circular machine in which the knitted item is lifted from the knitting formation plane also by its parts closest to the needles for reliable picking.

These purposes are achieved in a circular machine with a lifting device for the knitted item which includes a lifting pipe located in the cylinder, rotating together with this, adjustable in height and fitted with a summit bell with a flared lip which extends above the internal small sinker crown, as far as the circumference of the needles and which is provided with radial slits corresponding to the sinkers.

Such a system permits the knitted item to rest on the flaring of the bell, while the knitted item is knitted and to be raised on completion, especially in at a part of the knitted item closest to the needles. On the other hand, the radial slits of the bell's flared lip permit correct sinker movement, avoiding interference with the sinkers.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
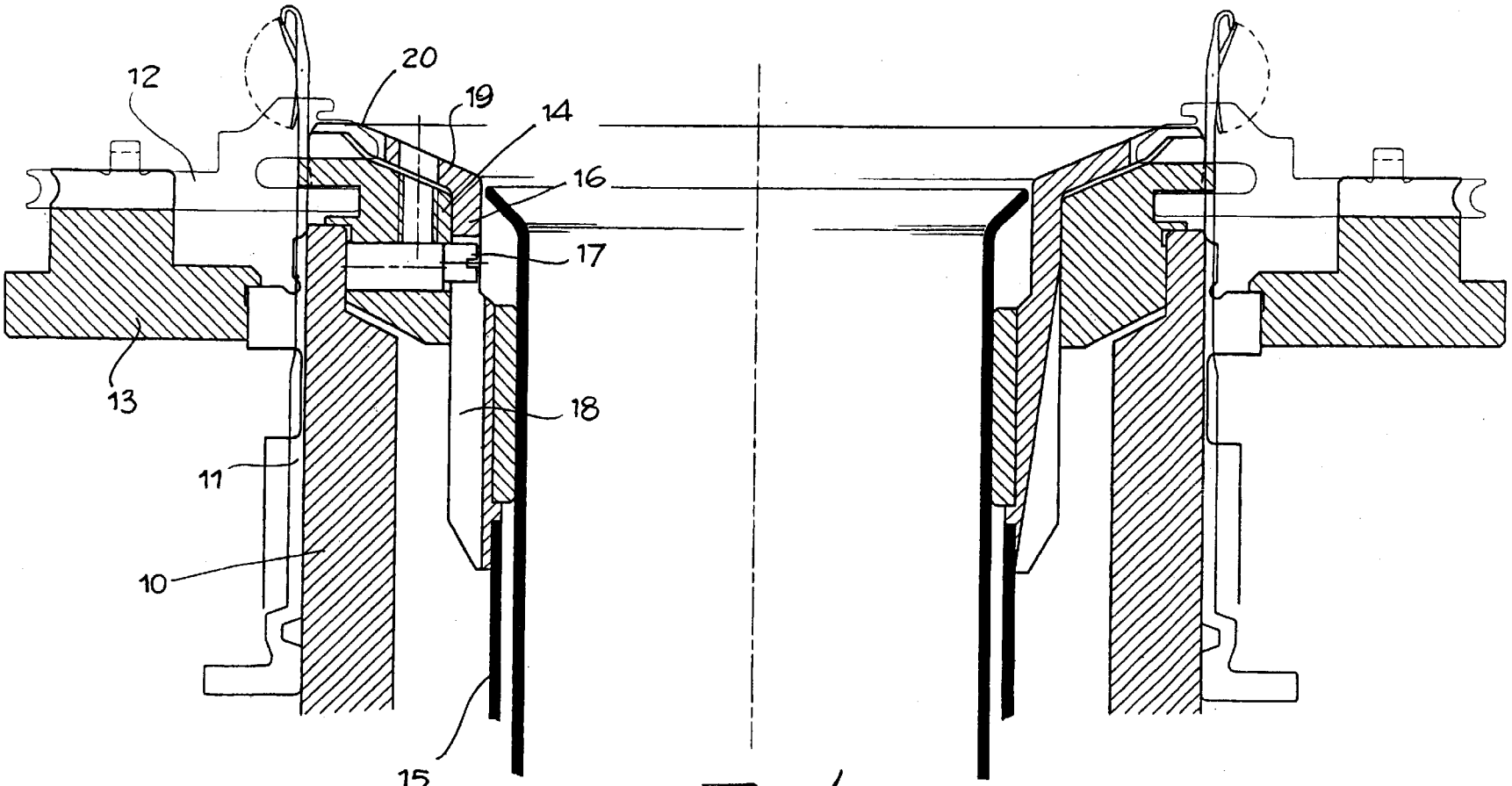
FIG. 1 is a view of a section of the summit portion of a circular machine cylinder for knitting according to the invention.

In the drawings of a circular machine for knitwear of the type considered, a cylinder 10, with needles 11 and sinkers 12 located radially around the summit of the cylinder are represented, supported by an external crown 13 and an internal crown 13 guiding their radial horizontal movements.

According to the invention, inside the cylinder 11 and coaxial to the same there is a pipe 15 which can be moved in height between a lowered position and a raised one, ending at the top with a bell 16. The bell 16 and the pipe 15, rotate together with the internal sinker crown 14 to which they are constrained by at least one rotation drive pin 17. This drive pin 17 engages in a corresponding vertical slit 18 which permits the height movements of the bell 16 when the pipe 15 is raised and lowered through an appropriate control device, not worthy of particular attention here.

Figure 2:
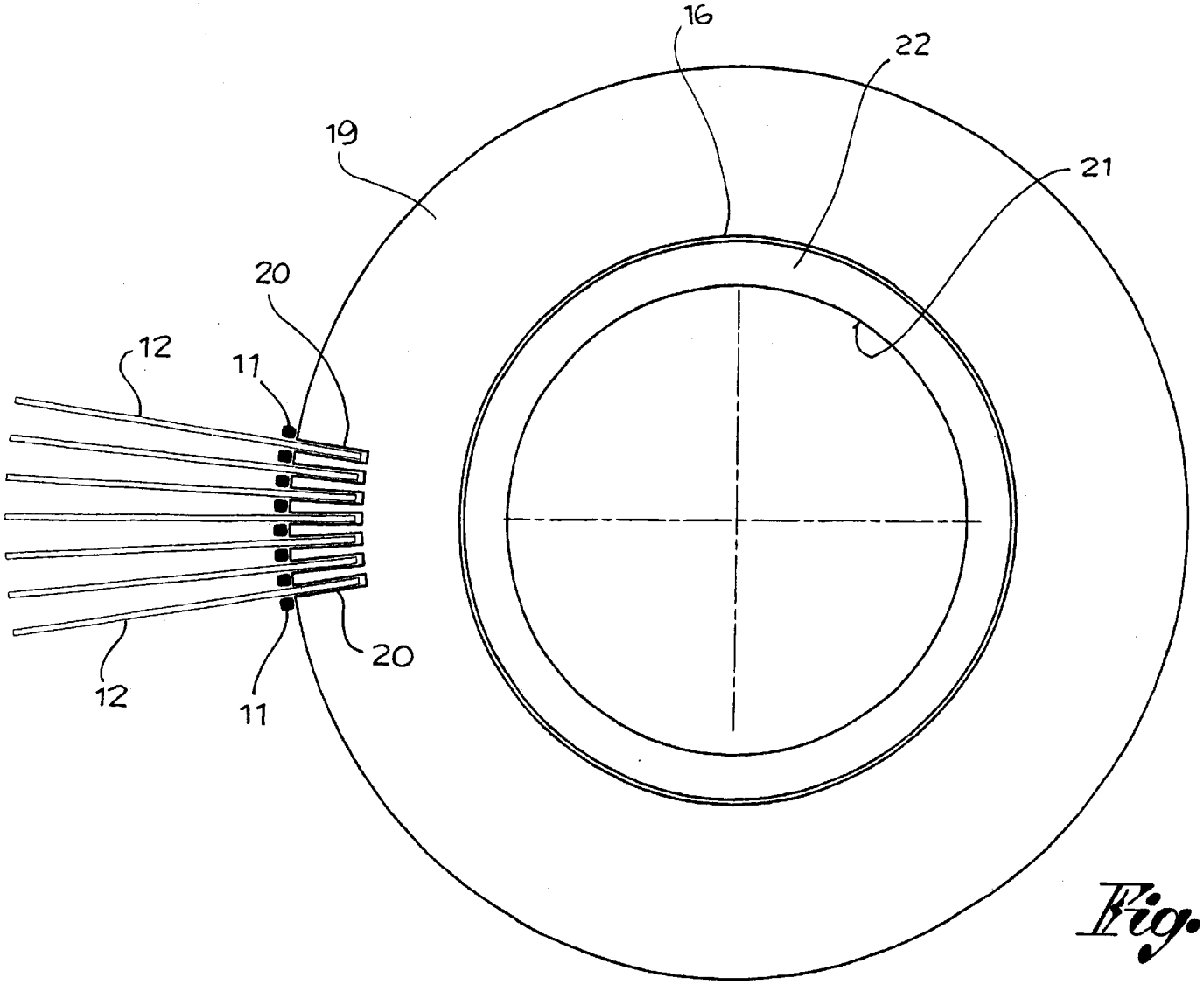
FIG. 2 is an aerial view of the knitting lifting device.

The bell has an upper flared lip 19 which extends above the small internal crown of the sinkers close to needles 11 on the cylinder. The flared lip has radial slits 20 around the periphery corresponding to the sinkers, see FIG. 2, so as to permit the radial movements of these without interference.

The pipe 15 with the bell 16 which can move in height and rotates can be placed outside an internal pipe 21 which has a summit flare that to coincides with the flared lip 19 of the bell when this is in the lowered position. The internal pipe 21 can be rotating or non-rotating, is fixed in height and is destined to receive the knitted item as it is gradually constructed.

In practice, as the knitting progresses, the knitting rests on the flared lip 19 of the bell 16 and passes into the internal pipe 21 without impediment. Once the item is completed the external pipe 15 is lifted up, with a consequent upwards movement of the bell and which also raises the knitted item including its parts closest to the needles, permitting its secure grasp for the picking and following handling.

While specific embodiments of the invention have been shown and described in detail to illustrate the application of the principles of the invention, it will be understood that the invention may be embodied otherwise without departing from such principles.

What is claimed is:

1. A circular knitting machine comprising:

a cylinder with needles, said cylinder having a summit;

a plurality of sinkers arranged around said summit of said cylinder;

a crown supporting said sinkers;

a lifting pipe arranged inside said cylinder and coaxial with said cylinder, said lifting pipe having an end closest to said crown, said end having a summit bell with a flared lip, said flared lip defining a plurality of radial slits receivable of said sinkers, said lifting pipe being movably mounted in the knitting machine between first and second axially spaced positions to move an item knitted by the knitting machine.

2. A circular knitting machine in accordance with claim 1, wherein:

said crown includes an external and an internal crown;

a drive pin is mounted on said internal crown;

said lifting pipe defines a slit receiving said drive pin, said drive pin and said slit rotationally fix said lifting pipe to said internal crown, said drive pin and said slit arrange said lifting pipe axially movable with respect to said internal crown.

3. A circular knitting machine in accordance with claim 1, wherein:

said flared lip of said bell is arranged close to said crown in said first position of said lifting pipe, said flared lip of said bell forms a support and a sliding plane for the item knitted by the knitting machine in said first position of said lifting pipe.

4. A circular knitting machine in accordance with claim 1, wherein:

said flared lip of said bell is arranged close to said crown in said first position of said lifting pipe, said flared lip of said bell forms a support and a sliding plane for the item knitted by the knitting machine in said first position of said lifting pipe.

5. A circular knitting machine in accordance with claim 3, wherein:

said flared lip lifts the knitted item from said needles during movement of said lifting pipe from said first position to said second position.

6. A circular knitting machine in accordance with claim 1, further comprising:

an internal pipe arranged in said lifting pipe, said internal pipe including a flared summit corresponding with said flared lip of said lifting pipe when said lifting pipe is in said first position, said flared summit of said internal pipe being receivable of the item knitted by the knitting machine.

7. A circular knitting machine in accordance with claim 2, further comprising:

an internal pipe arranged in said lifting pipe, said internal pipe including a flared summit corresponding with said flared lip of said lifting pipe when said lifting pipe is in said first position, said flared summit of said internal pipe being receivable of the item knitted by the knitting machine.

8. A circular knitting machine in accordance with claim 3, further comprising:

an internal pipe arranged in said lifting pipe, said internal pipe including a flared summit corresponding with said flared lip of said lifting pipe when said lifting pipe is in said first position, said flared summit of said internal pipe being receivable of the item knitted by the knitting machine when said lifting pipe is in said first position.

9. A lifting device for a circular knitting machine comprising:

a lifting pipe arranged inside a cylinder of the circular knitting machine, said lifting pipe being coaxial with said cylinder, said lifting pipe having an end closest to a crown of the knitting machine, said end having a summit bell with a flared lip, said flared lip defining a plurality of radial slits receivable of sinkers of the knitting machine, said lifting pipe being movably mounted in the knitting machine between first and second axially spaced positions to move an item knitted by the knitting machine.

10. A lifting device in accordance with claim 9, wherein:

the crown includes an external and an internal crown;

a drive pin is mounted on the internal crown;

said lifting pipe defines a slit receiving said drive pin, said drive pin and said slit rotationally fix said lifting pipe to the internal crown, said drive pin and said slit arrange said lifting pipe axially movable with respect to the internal crown.

11. A lifting device in accordance with claim 9, wherein:

said flared lip of said bell is arranged close to the crown in said first position of said lifting pipe, said flared lip of said bell forms a support and a sliding plane for the item knitted by the knitting machine in said first position of said lifting pipe.

12. A lifting device in accordance with claim 11, wherein:

said flared lip lifts the knitted item from the needles during movement of said lifting pipe from said first position to said second position.

13. A lifting device in accordance with claim 9, further comprising:

an internal pipe arranged in said lifting pipe, said internal pipe including a flared summit corresponding with said flared lip of said lifting pipe when said lifting pipe is in said first position, said flared summit of said internal pipe being receivable of the item knitted by the knitting machine when said lifting pipe is in said first position.

* * * * *